US005694638A

United States Patent [19]

Maruyama et al.

[11] Patent Number: 5,694,638

[45] Date of Patent: Dec. 2, 1997

[54] IMAGE GENERATING DEVICE

[75] Inventors: Yuichi Maruyama, Yashio; Junji Nakai; Sakae Ishikawa, both of Yokohama; Hiroyuki Gotoh, Kawasaki; Shoji Hayashi, Yokohama, all of Japan

[73] Assignee: Ricoh Company, Ltd., Tokyo, Japan

[21] Appl. No.: 678,883

[22] Filed: Jul. 12, 1996

[30] Foreign Application Priority Data

Jul. 13, 1995 [JP] Japan ..... 7-201617

[51] Int. Cl.[6] ..... G03G 15/00

[52] U.S. Cl. ..... 399/45; 399/397

[58] Field of Search ..... 399/45, 68, 381, 399/383, 384, 388, 400, 405, 389, 397, 322, 361; 271/278, 188

[56] References Cited

U.S. PATENT DOCUMENTS 4,595,279 6/1986 Kuru et al. ..... 399/45
4,941,021 7/1990 Uchida et al. ..... 399/322
5,189,470 2/1993 Matsuda et al. ..... 399/68
5,312,108 5/1994 Hayashi ..... 271/188
5,424,821 6/1995 Sampath ..... 399/45
5,493,374 2/1996 Smith et al. ..... 399/322
5,535,012 7/1996 Matsumoto et al. ..... 399/397 X

*Primary Examiner*—Sandra L. Brase
*Attorney, Agent, or Firm*—Oblon, Spivak, McClelland, Maier & Neustadt, P.C.

[57] ABSTRACT

An image generating device is provided with a control mechanism which controls an exit paper delivery speed after an image has been fixed to a form. The exit paper delivery speed is changed depending on information detected about the process of generating the image to prevent the form from being delivered with wrinkles. The information detected includes size of paper intervals between forms, length of forms, and whether the image generating process is a repeat copying or continuous form feeding process.

30 Claims, 3 Drawing Sheets

IMAGE GENERATING DEVICE

BACKGROUND OF THE INVENTION

1. Field of the Invention

The present invention relates to an image generating device such as a copying machine for preventing forms from wrinkling while they are delivered and output.

2. Discussion of the Background Art

FIG. 3 is a schematic diagram of a sample paper delivery and output system of a general image generating device. Form 1 is taken out of a feeder (not shown) with its stance being corrected by register rollers 2, and then fed to a sensitized material 3. In a given developing process, an image generated on the sensitized material 3 is transferred to the form 1 by a transfer wire 4. The form 1 is separated from the sensitized material 3 by a separation wire 5 and fed to a fixing roller 7 by a conveyor belt 6. The conveyor belt 6 is moved by a driving roller 8 and a following roller 9. The fixing roller 7 is heated (15° C. to 20° C. in a normal copying machine) by a heater (not shown), and an image transferred to the form 1 from the sensitized material 3 is fixed to the form 1 with the heat and a pressure applied between the fixing roller 7 and a press roller 10. The form 1, on which the image has been fixed, is fed out of the machine by two paper output rollers 11 constituting a paper output portion.

A linear delivery speed of the form 1 between the paper output rollers 11 is equal to a paper linear delivery speed at a fixing portion, in which the fixing roller 7 and the press roller 10 constitute the fixing portion. A roller linear speed of the paper output rollers 11 is set equal to or slightly higher than the paper linear delivery speed at the fixing portion. Therefore, the paper output rollers 11 are rotated synchronously with the form 1. It is effective to prevent the form 1 from slackening at the fixing and paper output portions to prevent a distortion of the form 1 such as, for example, wavy wrinkles and stringy wrinkles, which are often generated after fixing as illustrated in FIG. 4 and FIG. 5, respectively. The arrow in FIG. 4 and FIG. 5 indicate a paper output direction.

Since the paper output rollers 11 are always rotating at a certain speed in the above operation (Refer to Japanese Unexamined Patent Publication (Kokai) No. 03-216689, for example), they are in contact with the form 1, which was heated at the fixing portion, for a longer time than for normal copying when forms having a regular size or larger are fed continuously, hereinafter referred to as continuous form feeding or when an image is copied on a plurality of forms at shorter intervals between forms (for example, an image is generated on a plurality of forms from a single copy), hereinafter referred to as repeat copying. When the paper output rollers 11 are in contact with the form 1 for a long time, they absorb heat from the form 1 and may experience a greater paper delivery force (frictional force) or an increase in the roller diameters due to their expansion (if they are made of rubber).

SUMMARY OF TEE INVENTION

Accordingly, an object of the present invention is to provide an image generating device for reliably delivering and outputting various forms without wrinkles, using an inexpensive configuration.

This object is achieved by varying and controlling a speed of rollers in a paper delivery configuration after an image has been fixed to a form. The speed of the rollers is determined with information provided by a detecting mechanism that detects paper delivery information, such as various form sizes, number of copies selected, and elapsed time from a start of an image generating operation.

DETAILED DESCRIPTION OF THE PREFERRED EMBODIMENTS

Figure 1:
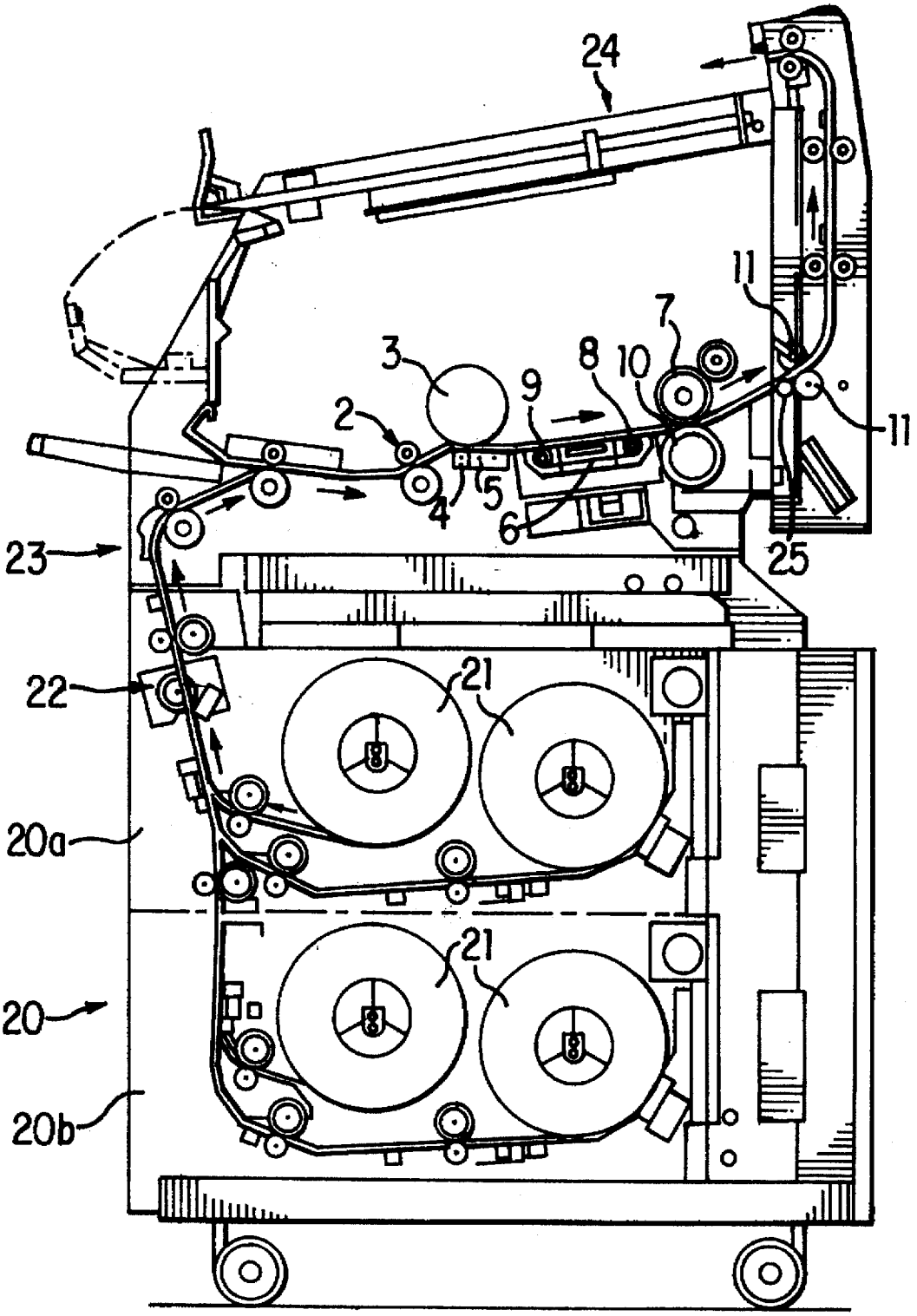
FIG. 1 is a sectional view illustrating an internal mechanism of an image generating device according to an embodiment of this invention.

Preferred embodiments of this invention will be described below by using the accompanying drawings. In the following description, the same reference characters as for the conventional one designate corresponding parts in the several views.

FIG. 1 is a sectional view illustrating an internal mechanism of a preferred embodiment of an image generating device of the present invention. A feeding tray 20 of the device consists of two stages; an upper tray **20*a* and a lower tray 20*b*, each having a configuration to hold two rolls of machine glazed paper 21. Each roll paper 21 is, for example, delivered in a direction as shown by an arrow from the roll paper 21 through the left sidme of the upper tray 20*a* and the delivered roll paper 21 is cut to a certain length by a roll cutter unit 22. The cut paper is then fed to a main body 23** of the device.

The form 1 that is cut and fed in this manner is corrected to an appropriate stance by register rollers 2 and fed to a sensitized material 3. An image generated on the sensitized material 3 is transferred to the form 1 by a transfer wire 4. The form 1 is then separated from the sensitized material 3 by a separation wire 5 and fed to a fixing roller 7 by a conveyor belt 6 where the image is fixed to the form 1 with heat. The form 1 is then output to a paper output tray 24 by paper output rollers 11, which constitute a paper output portion.

A paper output sensor 25 is provided between the fixing roller 7 and the paper output rollers 11 to determine whether or not the form 1 exists on the paper output portion. In addition, the main body 23 has a means for driving and controlling a roller linear speed of the paper output rollers 11, as well as an operating portion (not shown) for entering start instructions, information about forms to be delivered, and repeat copying or continuous form feeding information.

Figure 2:
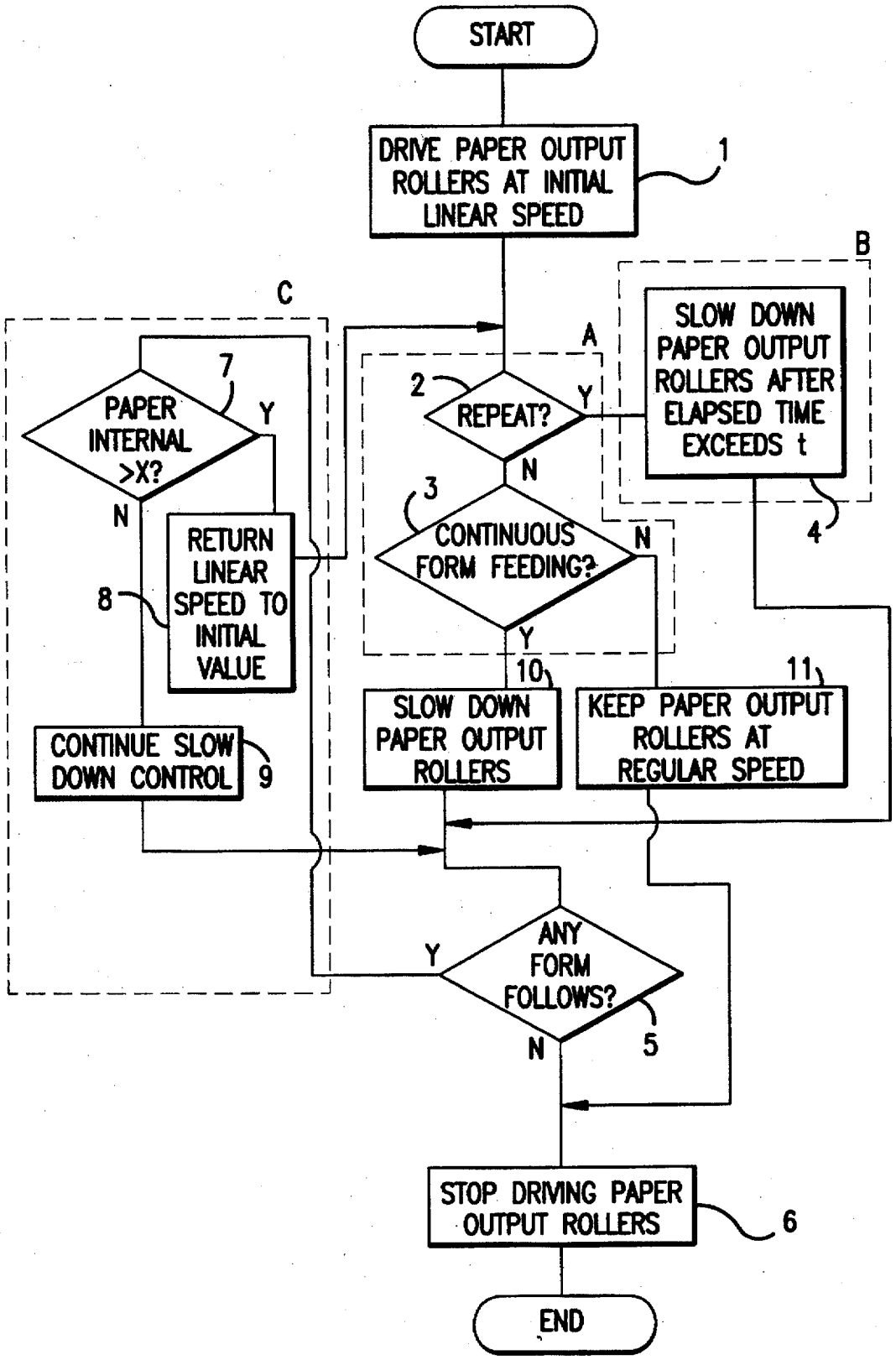
FIG. 2 is a flowchart of operations related to a paper delivery and output system according to the embodiment of the device as shown in FIG. 1.
Figure 3:
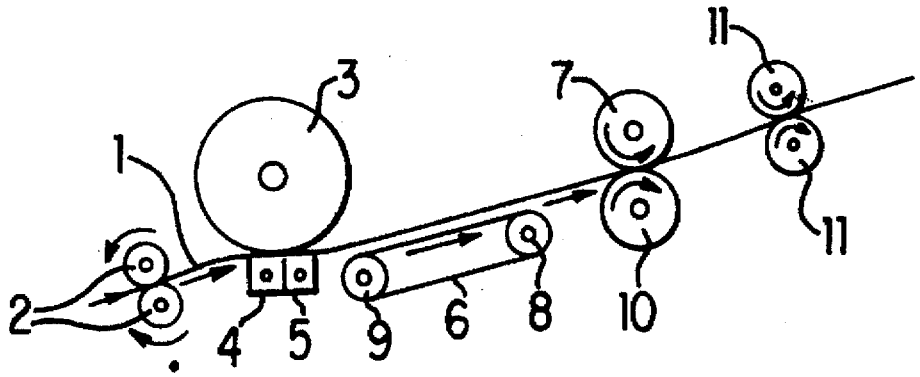
FIG. 3 is a schematic diagram showing a paper delivery and output system of a general conventional image generating device.
Figure 4:
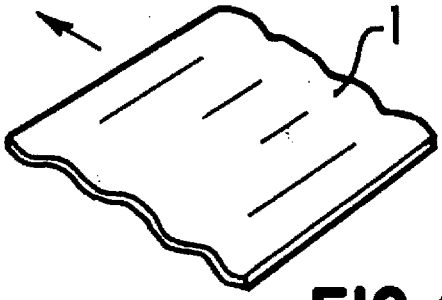
FIG. 4 is a perspective view showing wavy wrinkles on a form.
Figure 5:
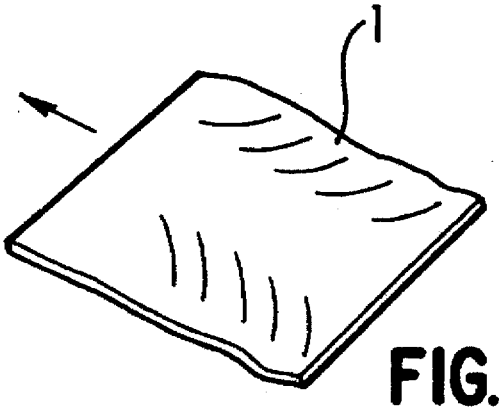
FIG. 5 is a perspective view showing stringy wrinkles on a form.

FIG. 2 is a flowchart of operations related to the paper delivery and output system of the device according to the embodiment in FIG. 1. With the start instructions from the above operating portion, the image generation process begins and the paper output rollers 11 are driven to start rotating at an initial linear speed (Step 1). Subsequently, it is determined whether or not the operation is repeat copying (step 2) and whether or not the operation is continuous form feeding (step 3) based on the information entered from the operating portion. The determination section A (step 2 and step 3) is enclosed by a dashed line shown in FIG. 2.

If the operation is determined to be repeat copying (YES in step 2), a time is measured beginning when the paper output sensor 25 has detected that a top of the form 1 reached the paper output rollers 11. If the time exceeds a given time t, a roller linear speed of the paper output rollers 11 is lowered to a range between a linear speed of the form 1 at the fixing portion and an initial value of the linear speed of the paper output rollers 11, by a driving control means which is not shown (step 4) to prevent the form 1 from being delivered with wrinkles. This processing is indicated by section B enclosed by a dashed line shown in FIG. 2.

Next, it is determined by the detecting function of the paper output sensor 25 whether or not there is any subsequent form (step 5). If a form is not detected, driving of the paper output rollers 11 is stopped (step 6). Otherwise, processing proceeds to steps 7 to 9 indicated by section C enclosed by a dashed line. If there is an affirmative answer in step 5, the paper output rollers 11 are driven continuously in a control state in which the paper output rollers 11 have been slowed down by either step 4 or step 10. An interval between a trailing edge of a preceding form and a front edge of a following form (paper interval) is detected by the paper output sensor 25 for determination in step 7. If the paper interval is greater than given value x (YES in step 7), the linear speed of the paper output rollers 11 is returned to the initial value (step 8) and the determinations in sections A and B are repeated. If the paper interval is smaller than the given value x (NO in step 7), the step 9 continues the slowdown control by further decreasing the linear speed of the output rollers 11 to prevent the form 1 from being delivered with wrinkles, and then processing returns to the determination in step 5 again.

If copying is started again during paper output of a last form under a repeat copying operation in a control state such that the paper output rollers 11 have been slowed down as described above, the linear speed of the paper output rollers 11 will be lower than its initial value. Therefore, the form 1 will slacken between the fixing portion and the paper output portion if the linear speed of the paper output rollers 11 is left without any change. However, the paper interval between the last form under paper output and a form started to be copied is greater than the given value x. Accordingly, in step 8, form 1 will be prevented from wrinkling by returning the linear speed of the paper output rollers 11 to its initial value.

If it is determined that the operation is not repeat copying as a result of the determination in the section A (NO in step 2) and also that the operation is a continuous form feeding (YES in step 3), the roller linear speed of the paper output rollers 11 is lowered to a range between the linear speed of the form 1 at the fixing portion and an initial value of the linear speed of the paper output rollers 11, by the driving control means (step 10) to prevent the delivered form 1 from wrinkling, and then processing proceeds to step 5. Determinations and processing following step 5 are the same as described above. If it is determined that the operation is not continuous form feeding, since a form length value is smaller than the given value L (NO in step 3), the linear speed of the paper output rollers 11 is kept at a regular level to deliver the form without wrinkles (step 11). The processing then proceeds to step 6, after delivering the form, to stop the driving of the paper output rollers 11.

Although whether or not the operation is continuous form feeding is determined by an input to the operating portion in the above embodiments, it can also be determined based on a detected length of the form through actual continuous form feeding by setting an appropriate sensor in the main body of the device in another configuration.

As has been described above in detail, according to the present invention, an image generating device can be obtained which delivers and outputs various forms without wrinkles reliably using an inexpensive configuration, by determining and controlling the appropriate paper delivery speed.

What is claimed is:

1. A method for generating and delivering an image on a form wrinkle-free, comprising the steps of:

feeding a form downstream in a paper delivery direction from a first location to a second location;

generating an image on the form at the second location;

fixing the image to the form;

delivering the form further downstream in the paper delivery direction from the second location to a third location;

detecting information about the step of generating the image;

controlling an initial speed of the delivery step to be higher than an entry paper delivery speed to the second location at a start of the step of generating the image; and controlling an exit paper delivery speed using the information which was detected.

2. A method according to claim 1, wherein:

the step of detecting comprises detecting whether the step of generating the image is a repeat process; and the step of controlling the exit paper delivery speed comprises controlling the exit paper delivery speed depending on whether the step of generating the image is said repeat process.

3. A method according to claim 2, wherein:

the step of controlling the exit paper delivery speed comprises controlling the exit paper delivery speed to slowdown after an elapsed time has passed from a start of the repeat process of generating an image.

4. A method according to claim 1, wherein:

the step of detecting comprises detecting whether the step of generating the image is a continuous form feeding process; and the step of controlling the exit paper delivery speed comprises controlling the exit paper delivery speed depending on whether the step of generating the image is said continuous form feeding process.

5. A method according to claim 4, wherein:

the step of controlling the exit paper delivery speed comprises controlling the exit paper delivery speed to slowdown when the step of generating the image is said continuous form feeding process.

6. A method according to claim 4, wherein:

the step of controlling the exit paper delivery speed comprises controlling the exit paper delivery speed to maintain a regular speed when the step of generating the image is other than said continuous form feeding process.

7. A method according to claim 1, wherein:

the step of detecting comprises detecting a paper interval between a trailing edge of a preceding form and a front edge of a following form; and the step of controlling the exit paper delivery speed comprises controlling the exit paper delivery speed depending on the paper interval detected.

8. A method according to claim 7, wherein:

the step of controlling the exit paper delivery speed comprises controlling the exit paper delivery speed to return to said initial speed when the detected paper interval is greater than a predetermined paper interval.

9. A method according to claim 8, wherein:

the step of controlling the exit paper delivery speed comprises controlling the exit paper delivery speed to slowdown when the detected paper interval is less than the predetermined paper interval.

10. A method according to claim 1, wherein:

the step of detecting comprises detecting whether there is a subsequent form; and the step of controlling the exit paper delivery speed comprises controlling the exit paper delivery speed depending on whether said subsequent form is detected.

11. A device for generating and delivering an image on a form wrinkle-free, comprising:

means for feeding a form downstream in a paper delivery direction from a first location to a second location;

means for generating an image on the form at the second location;

means for fixing the image to the form;

means for delivering the form further downstream in the paper delivery direction from the second location to a third location;

means for setting a number of forms on which the image is generated;

means for detecting information about a step of generating the image;

means for controlling an initial speed of the delivery step to be higher than an entry paper delivery speed to the second location at a start of the step of generating the image; and means for controlling an exit paper delivery speed using the information which was detected.

12. A device according to claim 11, wherein:

the means for detecting detects whether the step of generating the image is a repeat process; and the means for controlling the exit paper delivery speed controls the exit paper delivery speed depending on whether the step of generating the image is said repeat process.

13. A device according to claim 12, wherein:

the means for controlling the exit paper delivery speed controls the exit paper delivery speed to slowdown after an elapsed time has passed from a start of the repeat process of generating an image.

14. A device according to claim 11, wherein:

the means for detecting detects whether the step of generating the image is a continuous form feeding process; and the means for controlling the exit paper delivery speed controls the exit paper delivery speed depending on whether the step of generating the image is said continuous form feeding process.

15. A device according to claim 14, wherein:

the means for controlling the exit paper delivery speed controls the exit paper delivery speed to slowdown when the step of generating the image is said continuous form feeding process.

16. A device according to claim 14, wherein:

the means for controlling the exit paper delivery speed controls the exit paper delivery speed to maintain a regular speed when the step of generating the image is other than said continuous form feeding process.

17. A device according to claim 11, wherein:

the means for detecting detects a paper interval between a trailing edge of a preceding form and a front edge of a following form; and the means for controlling the exit paper delivery speed controls the exit paper delivery speed depending on the paper interval detected.

18. A device according to claim 17, wherein:

the means for controlling the exit paper delivery speed controls the exit paper delivery speed to return to said initial speed when the detected paper interval is greater than a predetermined paper interval.

19. A device according to claim 18, wherein:

the means for controlling the exit paper delivery speed controls the exit paper delivery speed to slowdown when the detected paper interval is less than the predetermined paper interval.

20. A device according to claim 11, wherein:

the means for detecting detects whether there is a subsequent form; and the means for controlling the exit paper delivery speed controls the exit paper delivery speed depending on whether said subsequent form is detected.

21. An image generating device which delivers a form wrinkle-free, comprising:

a feeding section which feeds a form downstream in a paper delivery direction from a first location to a second location;

a generating device which generates an image on the form at the second location;

a fixing device which fixes the image to the form;

a delivering section which delivers the form further downstream in the paper delivery direction from the second location to a third location;

a detecting device which detects information about a step of generating the image; and a controlling device which controls an exit paper delivery speed from the second location using the information which was detected, in which said exit paper delivery speed is initialized to be higher than an entry paper delivery speed to the second location at a start of the step of generating the image.

22. A device according to claim 21, wherein:

the detecting device detects whether the step of generating the image is a repeat process; and the controlling device controls the exit paper delivery speed depending on whether the step of generating the image is said repeat process.

23. A device according to claim 22, wherein:

the controlling device controls the exit paper delivery speed to slowdown after an elapsed time has passed from a start of the repeat process of generating an image.

24. A device according to claim 21, wherein:

the detecting device detects whether the step of generating the image is a continuous form feeding process; and the controlling device controls the exit paper delivery speed depending on whether the step of generating the image is said continuous form feeding process.

25. A device according to claim 24, wherein:

the controlling device controls the exit paper delivery speed to slowdown when the step of generating the image is said continuous form feeding process.

26. A device according to claim 24, wherein:

the controlling device controls the exit paper delivery speed to maintain a regular speed when the step of generating the image is other than said continuous form feeding process.

27. A device according to claim 21, wherein:

the detecting device detects a paper interval between a trailing edge of a preceding form and a front edge of a following form; and the controlling device controls the exit paper delivery speed depending on the paper interval detected.

28. A device according to claim 27, wherein:

the controlling device controls the exit paper delivery speed to return to said initial speed when the detected paper interval is greater than a predetermined paper interval.

29. A device according to claim 28, wherein:

the controlling device the exit paper delivery speed to slowdown when the detected paper interval is less than the predetermined paper interval.

30. A device according to claim 21, wherein:

the detecting device detects whether there is a subsequent form; and the controlling device controls the exit paper delivery speed depending on whether said subsequent form is detected.

* * * * *